US006533622B1

(12) United States Patent
Zwaan et al.

(10) Patent No.: US 6,533,622 B1
(45) Date of Patent: Mar. 18, 2003

(54) JET PROPULSION PUMP

(76) Inventors: Hendrik Johannes Zwaan, 14 Newton Street, Bayswater, Western Australia, 6053 (AU); Craig Zwaan, 14 Newton Street, Bayswater, Western Australia, 6053 (AU)

( * ) Notice: Subject to any disclaimer, the term of this patent is extended or adjusted under 35 U.S.C. 154(b) by 0 days.

(21) Appl. No.: 09/869,868

(22) PCT Filed: Dec. 22, 1999

(86) PCT No.: PCT/AU99/01136

§ 371 (c)(1),
(2), (4) Date: Jul. 6, 2001

(87) PCT Pub. No.: WO00/40461

PCT Pub. Date: Jul. 13, 2000

(30) Foreign Application Priority Data

Jan. 7, 1999 (AU) ..... PP8047

(51) Int. Cl.[7] ..... B63H 11/00
(52) U.S. Cl. ..... 440/38
(58) Field of Search ..... 440/38, 46, 47; 114/151; 60/221

(56) References Cited

U.S. PATENT DOCUMENTS

| | | | | |
|---|---|---|---|---|
| 3,098,464 A | | 7/1963 | Holland | |
| 4,278,431 A | | 7/1981 | Krautkremer et al. | |
| 4,411,630 A | | 10/1983 | Krautkremer et al. | |
| 4,459,117 A | * | 7/1984 | Jordan | 415/143 |
| 4,838,821 A | | 6/1989 | Krautkremer | |
| 5,346,363 A | * | 9/1994 | Stallman et al. | 415/128 |
| 5,520,557 A | | 5/1996 | Kaul et al. | |

* cited by examiner

*Primary Examiner*—Stephen Avila
(74) *Attorney, Agent, or Firm*—Kohn & Associates, PLLC

(57) ABSTRACT

A jet propulsion pump (10) for use with watercraft includes a propeller (40) mounted on a shaft (42) for axial rotation, and a pump chamber (20) having a cylindrical inlet (30) and a downwardly inclined outlet (50) connected to an aperture (29) in the pump chamber (20). The propeller (40) is positioned within the cylindrical inlet (30). An outer wall portion (24) of the pump chamber (20) is outwardly spiralling from the cylindrical inlet (30) to assist flow of fluid entering the pump chamber (20) through the cylindrical inlet (30) and expelling from the pump chamber (20) at the downwardly inclined outlet (50).

17 Claims, 4 Drawing Sheets

JET PROPULSION PUMP

CROSS-REFERENCE TO RELATED APPLICATIONS

This patent application is a National Phase Concerning a Filing Under 35 U.S.C. 371, claiming the benefit of priority of PCT/AU99/01136, filed Dec. 22, 1999, which claims the benefit of priority of Australian Patent Application Number PP8047, filed Jan. 7, 1999, all of which are incorporated herein by reference.

FIELD OF THE INVENTION

This invention relates to a jet propulsion pump and in particular relates to a jet propulsion pump for use in canoes, kayaks and similar watercraft.

SUMMARY OF THE INVENTION

In accordance with a first aspect of the present invention there is provided a jet propulsion pump including a propeller mounted on a shaft for axial rotation, means to axially support the shaft with the propeller positioned within a pump chamber, and a downwardly inclined outlet connected to an aperture in the pump chamber. In accordance with a second aspect of the present invention there is provided a watercraft including a jet propulsion pump mounted in a floor of the watercraft, intermediate fore and aft of the watercraft, wherein the jet propulsion pump is in accordance with the present invention.

DESCRIPTION OF THE DRAWINGS

The present invention will now be described, by way of example only, with reference to the accompanying drawings, in which.

DETAILED DESCRIPTION OF AN EMBODIMENT OF THE INVENTION

Figure 1:
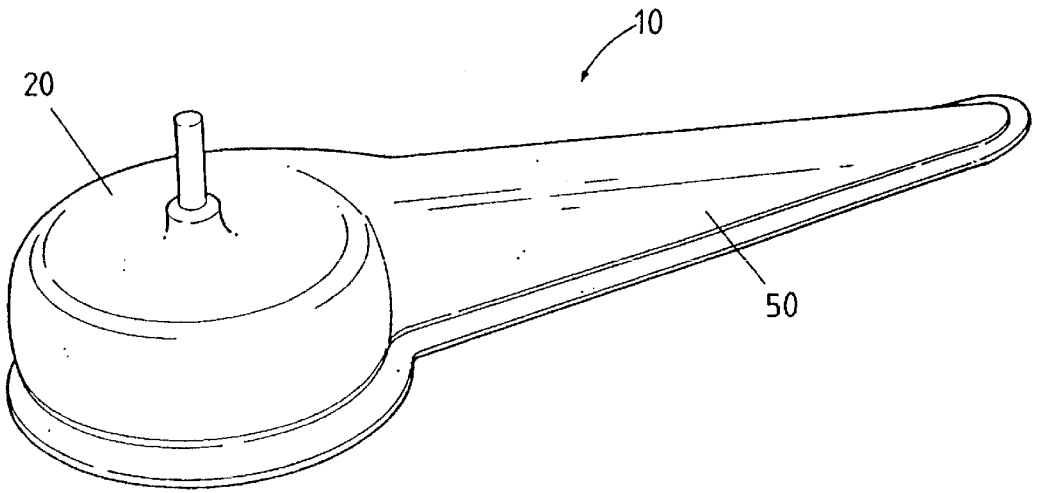
FIG. 1 is an upper perspective view of a jet propulsion pump in accordance with the present invention.
Figure 2:
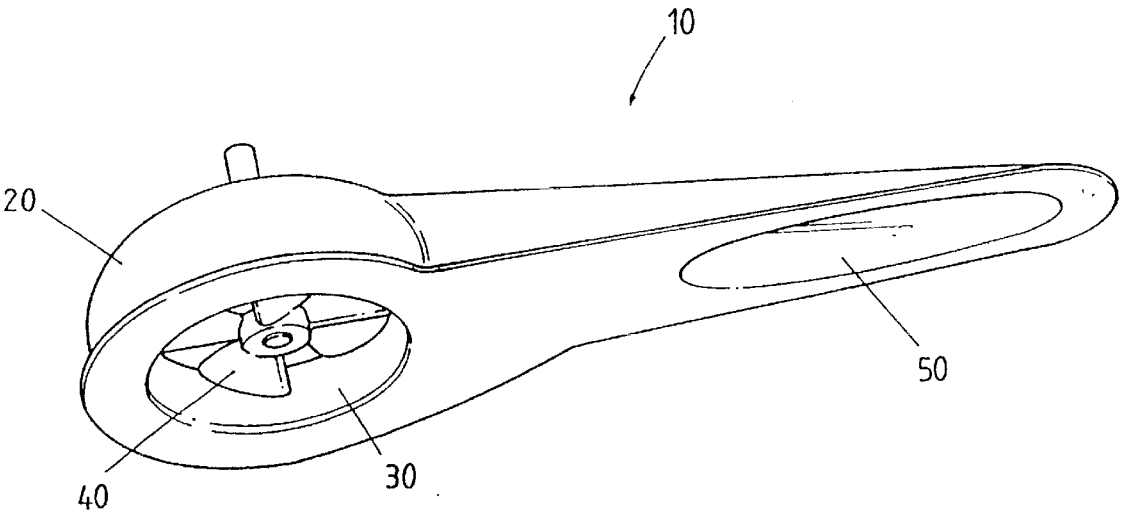
FIG. 2 is a lower perspective view of a jet propulsion pump in accordance with the present invention.

Referring to FIGS. 1 to 5 there is shown a jet propulsion pump 10 having a pump chamber 20, a cylindrical inlet 30, a propeller 40 and an outlet 50.

Figure 3:
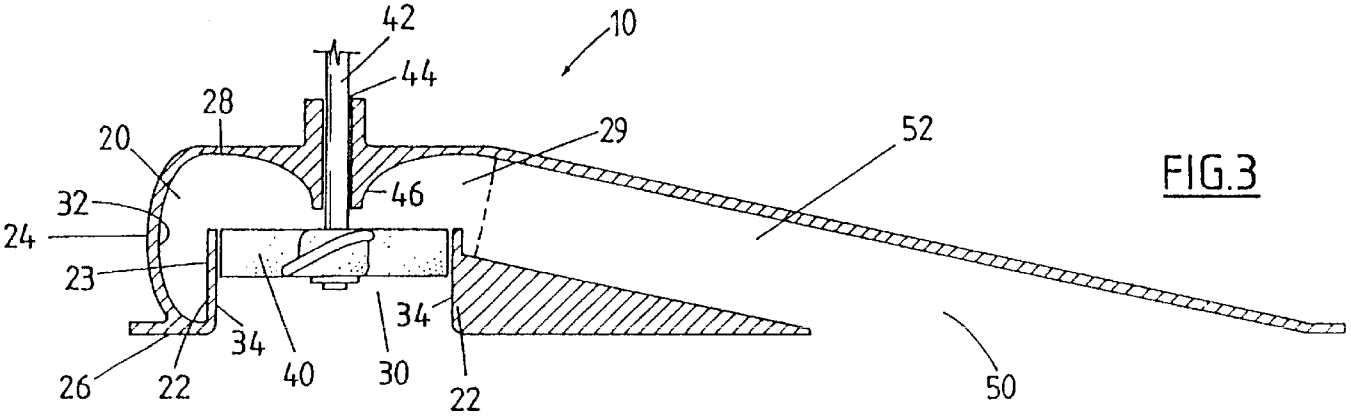
FIG. 3 is a longitudinal cross-sectional view of the jet propulsion pump in accordance with the present invention.
Figure 4:
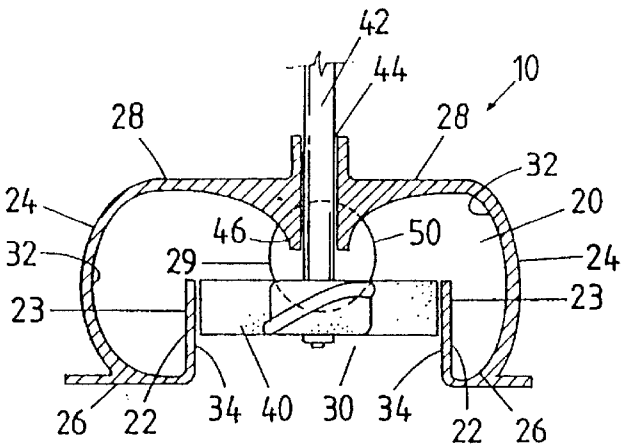
FIG. 4 is a transverse cross-sectional view of the jet propulsion pump in accordance with the present invention.
Figure 5:
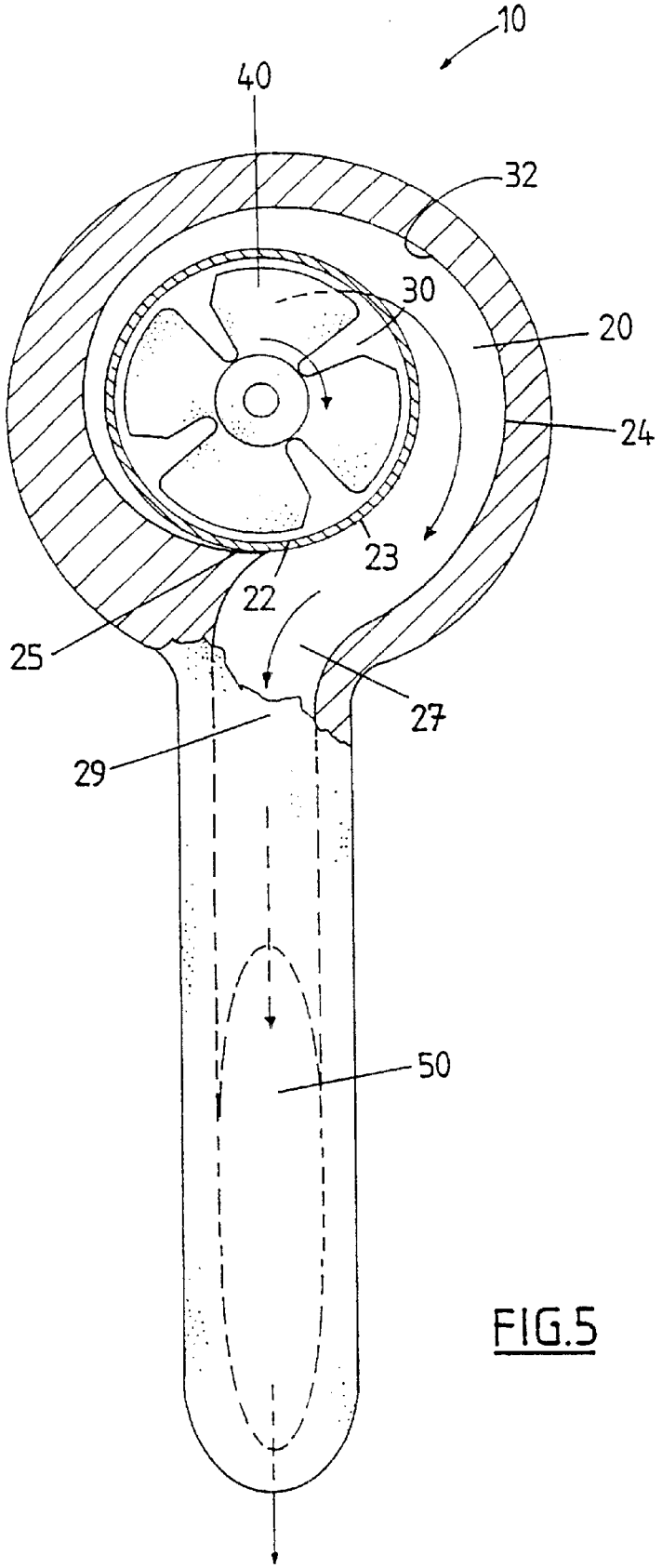
FIG. 5 is a lateral cross-sectional view of the jet propulsion pump in accordance with the present invention.

As shown in FIGS. 3, 4 and 5, the pump chamber 20 includes an inner circumferential wall 22 and an outwardly spiraling outer wall portion 24. A first end 25 of the outwardly spiralling wall portion 24 is contiguous with and outwardly spiraling from an outer surface 23 of the inner circumferential wall 22. A second end of the outwardly spiralling outer wall portion 24 is integral with a first end of a hollow elbow portion 27 disposed adjacent the first end 25 of the outwardly spiraling outer wall portion 24. A second end of the hollow elbow portion 27 is integral with the outlet

50. The hollow elbow portion 27 provides an outlet aperture 29 in the pump chamber 20 from which fluid taken into the pump chamber 20 may be expelled.

As shown in FIGS. 3 and 4, the outwardly spiraling outer wall portion 24 is of greater height than the inner circumferential wall 22. Preferably the difference in height between the outwardly spiraling outer wall portion 24 and the inner circumferential wall 22 is 30–45% of the radius of the cylindrical inlet 30, with optimal pump performance achieved when the difference in height between the outwardly spiraling outer wall portion 24 and the inner circumferential inner wall 22 is 37.5% of the radius of the cylindrical inlet 30.

Lower edges of the inner circumferential wall 22 and the outwardly spiraling outer wall portion 24 are substantially horizontally aligned and interconnected by a horizontal base wall 26. A substantially horizontal upper wall 28 is integral with an upper edge of the curved outer wall portion 24.

As shown in FIG. 5, an inner surface 32 of the outwardly spiraling outer wall portion 24 is spaced apart from the outer surface 23 of the inner circumferential wall 22 such that the distance between the inner surface 32 of the outwardly spiraling outer wall portion 24 and the outer surface 23 of the inner circumferential wall 22 incrementally increases from zero, where an edge of the outwardly spiraling outer wall portion 24 is contiguous with an outer surface 23 of the inner circumferential wall 22, to a maximum distance adjacent the first end of the elbow portion 27. Preferably, the distance between the inner surface 32 of the outwardly spiraling outer wall portion 24 and the outer surface 23 of the inner circumferential wall 22 incrementally increases from zero to a distance where a cross-sectional area of the is pump chamber 20 disposed between the inner circumferential wall and the outwardly spiraling outer wall portion 24 is up to 40% of the cross-sectional area of the cylindrical inlet 30. Optimal pump performance may be achieved when the cross-sectional area of the pump chamber 20 disposed between the inner circumferential wall 22 and the outwardly spiraling outer wall portion 24 adjacent the elbow 27 is about 25% of the cross-sectional area of the cylindrical inlet 30.

The cylindrical inlet 30 of the jet propulsion pump 10 includes a space integral with the inner surface 34 of the inner circumferential wall 22.

As shown in FIGS. 3 and 4, the horizontal upper wall 28 is provided with a downwardly depending substantially curved conical member 46 which radially extends from a first aperture 44 in the horizontal upper wall 28. The first aperture 44 is arranged to receive a shaft 42 on which the propeller 40 is mounted for axial rotation. The propeller 40 is disposed such that the rotational path of the propeller 40 is in close proximity to an inner surface 34 of the inner circumferential wall 22. Preferably, in order to provide optimal efficiency of the jet propulsion pump 10, upper edges of the propeller 40 are horizontally aligned with upper edges of the inner circumferential wall 22. Furthermore, in order to provide optimal efficiency of the jet propulsion pump 10, lower edges of the propeller 40 should preferably be aligned at least 13 mm above lower edges of the inner circumferential wall 22.

The outlet 50 includes a hollow tube member 52 endwise connected to the second end of the elbow portion 27. The cross-sectional area of the hollow tube member 52 is between 15–40% respectively, of the cross-sectional area of the cylindrical inlet 30. Preferably, the cross-sectional area of the hollow tube member 52 is 20% of the cross-sectional area of the cylindrical inlet 30.

The hollow tube member 52 is arranged to downwardly incline at an acute angle from the horizontal, preferably from between 12° to 16° from the horizontal.

Figure 6:
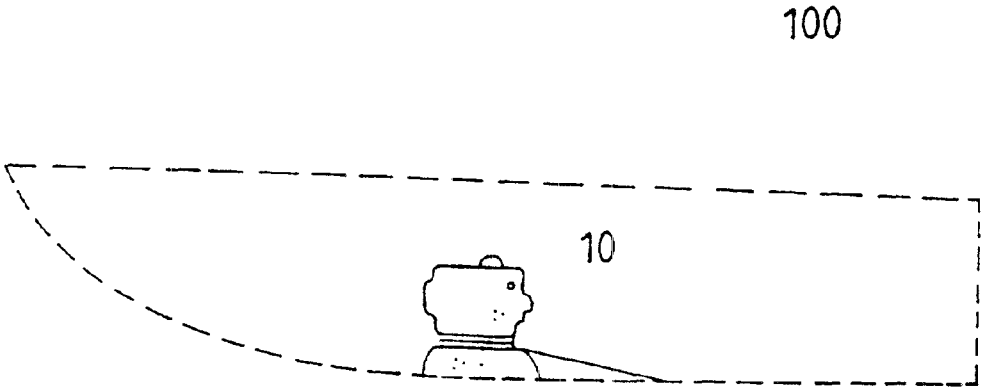
FIG. 6 is a side plan view of the jet propulsion pump as arranged to be used in a boat in conjunction with a driving motor, in accordance with the present invention.

In the present invention, as shown in FIG. 6, there is provided a watercraft 100 where the jet propulsion pump 10 is mounted intermediate fore and aft of the watercraft such that the outlet is directed towards the rear of the watercraft. Fluid flow is expelled from the downwardly inclined outlet 50 directly into a water body. Preferably, the jet propulsion pump 10 is mounted in a substantially central position in a base of a watercraft. It has been found that a central positioning of the jet propulsion pump 10 in the watercraft has the effect of trimming the nose of the watercraft, as well as assisting steerage of the watercraft.

It is envisaged that the jet propulsion pump 10 may be provided with a pump housing, the pump housing being slidably received in a receiving means which is integral with the base of the watercraft 100. The pump housing includes a base portion which is integral with the jet propulsion pump 10, a portion accommodating an inwardly extending flange at its lower edge and an outwardly extending flange at its upper edge, and a lid portion. The pump housing is assembled by fixedly attaching, by conventional fixing means, the mating faces of the inwardly extending flange of the wall portion and the base portion. The lid portion rests on top of the outwardly extending flange of the wall portion and may be secured thereto with a plurality of clips. The lid portion is provided with a plurality of apertures arranged to receive a control console, or fuel cap associated with the motor fitted to the jet propulsion pump 10. The lid portion also accommodates a handle for conveniently carrying the pump housing.

In this way, the jet propulsion pump 10 and pump housing may be conveniently removed from the watercraft 100 for repairs or maintenance.

In use, the jet propulsion pump 10 is arranged to be mounted in a base of the watercraft, at any position intermediate fore and aft of the watercraft. In this way, a lower portion of the pump, including the cylindrical inlet 30 and the outlet 50 will be immersed below the waterline.

A drive motor is mounted above the jet propulsion pump 10 and is arranged to axially rotate the shaft 42 and thereby drive the propeller 40. In use, the propeller 40 is arranged to draw fluid into the cylindrical inlet 30 and direct fluid flow into the pump chamber 20. The downwardly depending substantially curved conical member 46 is arranged to provide a streamlined path for the fluid flow into the pump chamber as fluid is drawn into the cylindrical inlet 30, thereby assisting the efficiency of the jet propulsion pump 10.

The outwardly spiraling outer wall portion 24 of the pump chamber 20 is arranged to direct and streamline fluid flow from the pump chamber 20 to the outlet 50. The outlet 50 has a substantially narrower cross-sectional area than the cylindrical inlet 30. Fluid flow is therefore much faster at the outlet 50 than fluid flow at the cylindrical inlet 30, which accounts for the jet propulsion action of the present invention. Furthermore, the outlet 50 is arranged to direct fluid flow out of the pump chamber at an acute angle below the horizontal 20 which has the effect of trimming the nose of the watercraft.

Modifications and variations such as would be apparent to a skilled addressee are deemed to be within the scope of the present invention.

What is claimed is:

1. A jet propulsion pump having a pump chamber, a shaft, a propeller mounted on the shaft for axial rotation, means to support the shaft for axial rotation with the propeller positioned within the pump chamber, an aperture in the pump chamber, and a downwardly inclined outlet connected to the aperture in the pump chamber, wherein the pump chamber comprises a cylindrical inlet located within the pump chamber and the propeller being mounted in the cylindrical inlet, an inner circumferential wall, an outwardly spiralling outer wall portion having an upper edge, the inner circumferential wall defining a space integral with the cylindrical inlet, the pump chamber further having a base wall, the inner circumferential wall and the outwardly spiralling outer wall portion having respective lower edges which are substantially horizontally aligned with one another and which are interconnected by the base wall, and an upper wall integral with the upper edge of the outwardly spiralling outer wall portion, the arrangement being such that, in use, fluid is lifted by the propeller into the pump chamber through the cylindrical inlet and then caused to flow radially along the upper wall and conjoining surfaces to pass through the aperture into the outlet.

2. A jet propulsion pump according to claim 1, characterised in that the downwardly inclined outlet is disposed at an acute angle below a horizontal plane.

3. A jet propulsion pump according to claim 2, characterised in that the acute angle is from between 12° to 16°.

4. The jet propulsion pump according to claim 1, wherein the downwardly inclined outlet has a substantially smaller transverse cross-sectional area than a lateral cross-sectional area of the cylindrical inlet.

5. The jet propulsion pump according to claim 4, wherein the cross-sectional area of the downwardly inclined outlet is from between 15 to 40% of the lateral cross-sectional area of the cylindrical inlet.

6. A jet propulsion pump according to claim 4, wherein the transverse cross-sectional area of the downwardly inclined outlet is about 20% of the lateral cross-sectional area of the cylindrical inlet.

7. A jet propulsion pump according to claim 1, wherein the upper edges of the propeller are horizontally aligned with an upper edge of the cylindrical inlet.

8. A jet propulsion pump according to claim 1, wherein the lower edges of the propeller are spaced apart from and above a lower edge of the cylindrical inlet.

9. A jet propulsion pump according to claim 8, characterised in that the lower edges of the propeller are disposed at least 13 mm above the lower edge of the cylindrical inlet.

10. The jet propulsion pump according to claim 9, wherein a distance between the outwardly spiralling wall portion and the inner circumferential wall incrementally increases from zero at a first end of the outwardly spiralling wall portion to a maximum distance at a second end of the outwardly spiralling wall portion, wherein the second end is adjacent to the downwardly inclined outlet.

11. The jet propulsion pump according to claim 10, wherein a cross-sectional area of the pump chamber disposed between the inner circumferential wall and the outwardly spiralling wall portion increases to up to 40% of the lateral cross-sectional area of the cylindrical inlet.

12. A jet propulsion pump according to claim 11, wherein a cross-sectional area of the pump chamber disposed between the inner circumferential wall and the outwardly spiraling wall portion increases to up to 25% of the lateral cross-sectional area of the cylindrical inlet.

13. A jet propulsion pump according to claim 1, wherein a height difference between the outwardly spiraling outer wall and the inner circumferential wall is 30 to 40% of a radius of the cylindrical inlet.

14. A jet propulsion pump according to claim 1, wherein an upper wall of the pump chamber is provided with a downwardly depending substantially conical member with a curved wall, wherein the conical member radially extends from an aperture for receiving the shaft in the horizontal upper wall.

15. A watercraft including a jet propulsion pump according to claim 1, wherein the jet propulsion pump is mounted in a floor of the watercraft, intermediate fore and aft of the watercraft.

16. A watercraft according to claim 15, characterised in that the jet propulsion pump is mounted in a substantially central position in the floor of the watercraft.

17. A watercraft according to claim 15, wherein the jet propulsion pump is enclosed in a pump housing, the pump housing being slidably received within a receiving means integral with the floor of the watercraft.

* * * * *